US009937369B2

(12) United States Patent
Tsutaki

(10) Patent No.: US 9,937,369 B2
(45) Date of Patent: Apr. 10, 2018

(54) FIRE EXTINGUISHING EQUIPMENT

(71) Applicant: IHI Corporation, Tokyo (JP)

(72) Inventor: Shigeo Tsutaki, Tokyo (JP)

(73) Assignee: IHI CORPORATION, Tokyo (JP)

( * ) Notice: Subject to any disclaimer, the term of this patent is extended or adjusted under 35 U.S.C. 154(b) by 81 days.

(21) Appl. No.: 14/878,970

(22) Filed: Oct. 8, 2015

(65) Prior Publication Data

US 2016/0030784 A1 Feb. 4, 2016

Related U.S. Application Data

(63) Continuation of application No. PCT/JP2014/067874, filed on Jul. 4, 2014.

(30) Foreign Application Priority Data

Jul. 8, 2013 (JP) ..... 2013-143076

(51) Int. Cl.
*A62C 35/11* (2006.01)
*A62C 37/40* (2006.01)
(Continued)

(52) U.S. Cl.
CPC ..... *A62C 35/11* (2013.01); *A62C 3/0214* (2013.01); *A62C 3/0221* (2013.01);
(Continued)

(58) Field of Classification Search
CPC ... A62C 35/11; A62C 3/0292; A62C 99/0009; A62C 3/0214; A62C 3/0221; A62C 37/40; A62C 99/0045; A62C 2/246
(Continued)

(56) References Cited

U.S. PATENT DOCUMENTS 3,752,235 A * 8/1973 Witkowski ..... A62C 35/605 169/26
6,819,237 B2 * 11/2004 Wilson ..... G08B 17/00 169/46
(Continued)

FOREIGN PATENT DOCUMENTS

JP 2002-291923 A 10/2002
JP 2003-746 A 1/2003
(Continued)

OTHER PUBLICATIONS

International Search Report dated Sep. 9, 2014 in PCT/JP2014/067874 (4 pages).

*Primary Examiner* — Arthur O Hall
*Assistant Examiner* — Tuongminh Pham
(74) *Attorney, Agent, or Firm* — Rothwell, Figg, Ernst & Manbeck, P.C.

(57) ABSTRACT

A fire-extinguishing equipment includes: a fire-extinguishing apparatus which transmits electromagnetic waves in a predetermined output direction and discharges an extinguishing agent; an electromagnetic wave-receiver which is provided in an fire extinguishing object and receives the electromagnetic waves; and a controller which controls the fire-extinguishing apparatus to start to discharge the extinguishing agent when the output direction is set to a direction of the fire extinguishing object and the electromagnetic wave-receiver receives the electromagnetic waves.

6 Claims, 3 Drawing Sheets

(51) Int. Cl.
*A62C 99/00* (2010.01)
*A62C 3/02* (2006.01)

(52) U.S. Cl.
CPC ..... *A62C 3/0292* (2013.01); *A62C 37/40* (2013.01); *A62C 99/0045* (2013.01)

(58) Field of Classification Search
USPC ..... 169/56, 46, 60, 61
See application file for complete search history.

(56) References Cited

U.S. PATENT DOCUMENTS

| | | | | |
|---|---|---|---|---|
| 2004/0129434 | A1* | 7/2004 | Tan | A62C 37/40<br>169/37 |
| 2012/0124850 | A1* | 5/2012 | Ortleb | G01C 15/06<br>33/228 |

FOREIGN PATENT DOCUMENTS

| | | | |
|---|---|---|---|
| JP | 2003-121149 | A | 4/2003 |
| JP | 2003-126286 | A | 5/2003 |
| JP | 2007-58529 | A | 3/2007 |
| JP | 2007-58530 | A | 3/2007 |
| JP | 2010-5217 | A | 1/2010 |
| JP | 2013-41604 | A | 2/2013 |

* cited by examiner

FIRE EXTINGUISHING EQUIPMENT

This application is a continuation application based on a PCT Patent Application No. PCT/JP2014/067874, filed on Jul. 4, 2014, whose priority is claimed on Japanese Patent Application No. 2013-143076, filed on Jul. 8, 2013. The contents of both the PCT Application and the Japanese Application are incorporated herein by reference.

TECHNICAL FIELD

The present disclosure relates to fire-extinguishing equipment.

BACKGROUND ART

In Patent Document 1 mentioned below, a fire extinguishing system is disclosed for specifying a fire's point of origin when a fire occurs in various structures such as buildings and tunnels, and performing a rapid, effective, and efficient fire-fighting operation only at the fire's point of origin. In this fire extinguishing system, when the break-out of a fire is detected by a fire detector, a fire's point of origin is specified by an infrared camera which detects infrared rays emitted from flames, and an extinguishing agent is allowed to be discharged to the fire's point of origin from an extinguishing agent discharge nozzle provided in a self-propelled fire extinguishing robot to extinguish the fire.

CITATION LIST

Patent Documents

Patent Document 1: Japanese Unexamined Patent Application, First Publication No. 2003-126286

SUMMARY

Technical Problem

However, in the related art, the fire's point of origin is specified by using the infrared camera which detects infrared rays emitted from flames. Therefore, time is needed for specifying the fire's point of origin, and there is a possibility that the fire-fighting operation may not be rapidly started. That is, at the scene of a fire, infrared ray emissions may be present in addition to flames. Therefore, the fire's point of origin is not easily specified, and as a result, there may be a case where it is difficult to rapidly perform the fire-fighting operation.

In addition, in the related art, an infrared camera which detects infrared rays emitted from flames is used. Therefore, a point that is not the fire's point of origin (infrared rays occurrence point) may be mistaken for the fire's point of origin, and as a result, there is a possibility that the fire-fighting operation may not be accurately performed.

The present disclosure has been made taking the foregoing circumstances into consideration, and an object thereof is to provide fire-extinguishing equipment capable of performing a fire-fighting operation more accurately and rapidly than in the related art.

Solution to Problem

According to a first aspect of the present disclosure, a fire-extinguishing equipment includes: a fire-extinguishing apparatus which transmits electromagnetic waves in a predetermined output direction and discharges an extinguishing agent; an electromagnetic wave-receiver which is provided in an fire extinguishing object and receives the electromagnetic waves; and a controller which controls the fire-extinguishing apparatus to start to discharge the extinguishing agent when the output direction is set to a direction of the fire extinguishing object and the electromagnetic wave-receiving receiver receives the electromagnetic waves.

Advantageous Effects

According to the present disclosure, since the discharge of the extinguishing agent is started under the condition that the electromagnetic waves transmitted from the fire-extinguishing apparatus are received by the electromagnetic wave-receiver provided in the fire extinguishing object, it is possible to perform a fire-fighting operation more accurately and rapidly than in the related art.

DESCRIPTION OF EMBODIMENTS

Hereinafter, an embodiment of the present disclosure will be described with reference to the drawings.

Figure 1:
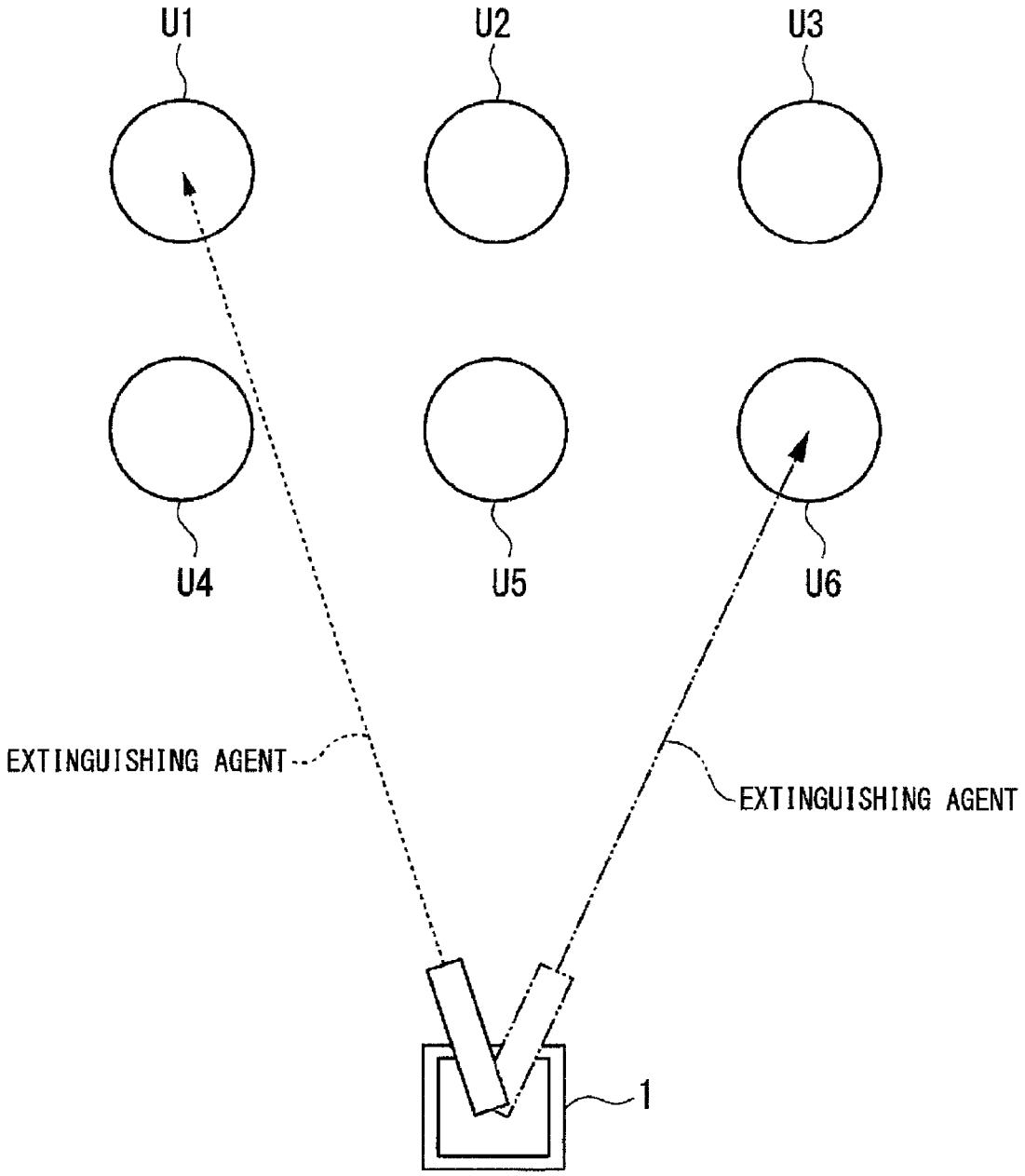
FIG. 1 is a schematic view illustrating the positional relationship between fire-extinguishing equipment according to an embodiment of the present disclosure and fire extinguishing objects.
Figure 2:
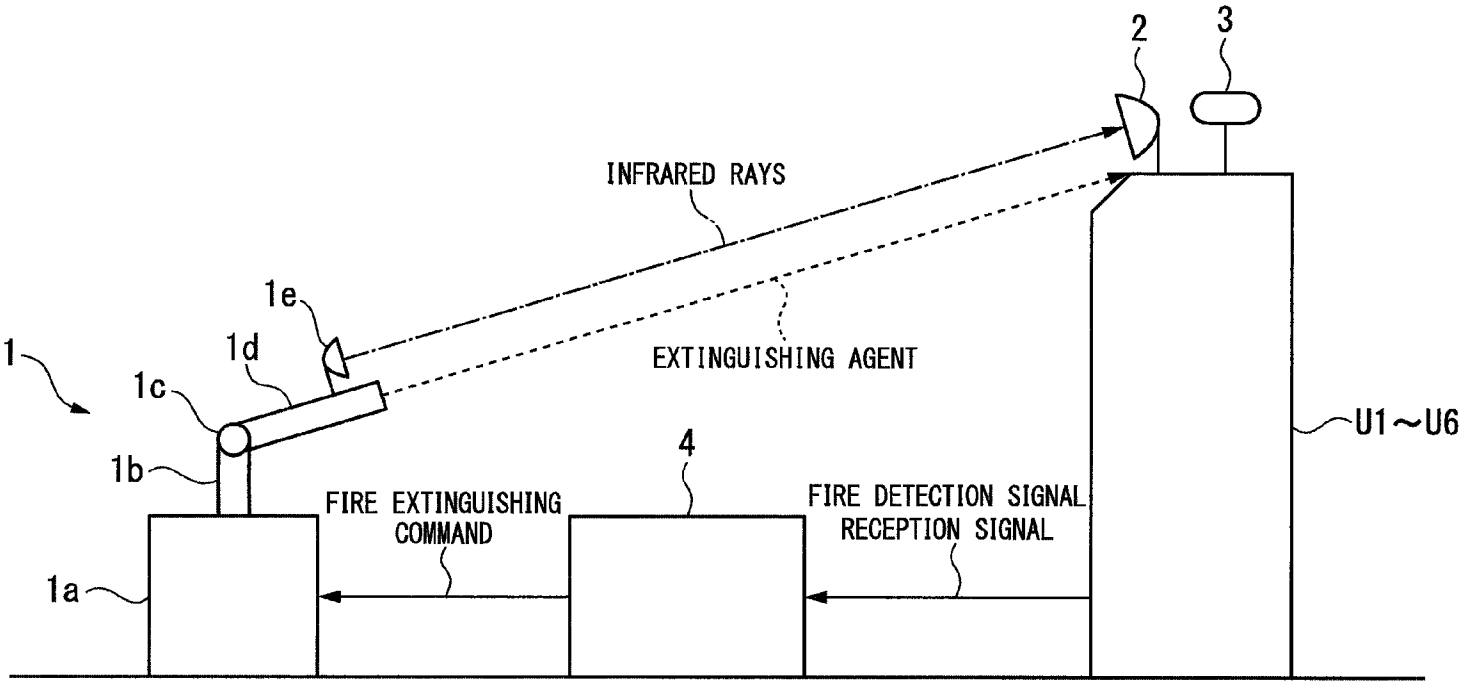
FIG. 2 is a schematic view illustrating the detailed configuration of the fire-extinguishing equipment according to the embodiment of the present disclosure.

Fire-extinguishing equipment according to the embodiment is provided in a facility such as a plant and, as illustrated in FIGS. 1 and 2, includes a fire-extinguishing apparatus 1, an infrared receiver 2 (electromagnetic wave-receiver), a fire detector 3, and a central controller 4. The fire-extinguishing equipment has a plurality of (six) plant units U1 to U6 as fire extinguishing objects, and extinguishes a fire that occurs in the plant units U1 to U6.

The plant units U1 to U6 are not particularly limited, and are relatively tall tower-shaped units among a plurality of various plant units included in the plant. As illustrated in FIG. 1, the plant units U1 to U6 are disposed on the ground to be separated from each other at predetermined distances.

The fire-extinguishing apparatus 1 discharges a predetermined powder extinguishing agent to the plant units U1 to U6 under the control of the central controller 4. As illustrated in FIG. 1, the fire-extinguishing apparatus 1 is disposed on the ground in a state of being separated from the plurality of plant units U1 to U6 at predetermined distances. That is, the distances between the fire-extinguishing apparatus 1 and the plurality of plant units U1 to U6 in a horizontal direction vary with the plant units U1 to U6. Although not illustrated in FIG. 1, the plurality of plant units U1 to U6 are not necessarily the same height, and thus the distances between the fire-extinguishing apparatus 1 and the plurality of plant units U1 to U6 in a vertical direction also vary with the plant units U1 to U6.

As illustrated in FIG. 2, the fire-extinguishing apparatus 1 includes a body 1*a*, a tube 1*b*, a joint 1*c*, a fire-extinguishing nozzle 1*d*, and an infrared transmitter 1*e*.

The body 1*a* includes a tank filled with the powder extinguishing agent and is disposed and fixed on the ground. The tube 1*b* is a straight tube that communicates with the tank of the body 1*a*, and extends upward from the body 1*a* as illustrated. The joint 1*c* is provided at the tip end portion of the tube 1*b* to allow the fire-extinguishing nozzle 1*d* to be rotatably connected to the tube 1*b*. The joint 1*c* supplies the powder extinguishing agent supplied from the body 1*a* via the tube 1*b* to the fire-extinguishing nozzle 1*d*.

In the joint 1*c*, for example, a motor is embedded as driving means. The motor is operated on the basis of a control signal input from the central controller 4 and sets a direction of the fire-extinguishing nozzle 1*d* on a horizontal plane and a vertical plane.

As illustrated, the fire-extinguishing nozzle 1*d* is a straight tube-shaped member having a predetermined length, and the rear end portion of the fire-extinguishing nozzle 1*d* is connected to the joint 1*c*. The powder extinguishing agent is supplied to the fire-extinguishing nozzle 1*d* from the body 1*a* via the tube 1*b* and joint 1*c*. The powder extinguishing agent is discharged from the tip end portion of the fire-extinguishing nozzle 1*d* in the tube axis direction (center axis direction). The tube axis direction is an output direction in this embodiment.

The infrared transmitter 1*e* is installed so as to be fixed to the fire-extinguishing nozzle 1*d*, and transmits infrared rays as a beam limited to the tube axis direction (output direction). That is, the transmission direction of infrared rays from the infrared transmitter 1*e* is exactly the same as the discharge direction of the powder extinguishing agent from the fire-extinguishing nozzle 1*d*. The discharge direction of the powder extinguishing agent from the fire-extinguishing nozzle 1*d* is set to be changed by the joint 1*c* in which the motor is embedded. Since the infrared transmitter 1*e* is installed so as to be fixed to the fire-extinguishing nozzle 1*d*, the transmission direction of infrared ray is set to be changed to exactly the same direction as the discharge direction of the powder extinguishing agent.

For example, when the direction of the fire-extinguishing nozzle 1*d* (that is, the discharge direction of the powder extinguishing agent) is set to a direction of the plant unit U1 by the joint 1*c*, the infrared transmitter 1*e* transmits infrared rays limited to the direction of the plant unit U1, which is the same as the direction of the fire-extinguishing nozzle 1*d*. On the other hand, when the direction of the fire-extinguishing nozzle 1*d* is set to a direction of the plant unit U6 by the joint 1*c*, the infrared transmitter 1*e* transmits infrared rays limited to the direction of the plant unit U6, which is the same as the direction of the fire-extinguishing nozzle 1*d*.

The infrared receiver 2 is provided at each of the top portions of the plant units U1 to U6, and when the infrared receiver 2 receives the infrared rays from the infrared transmitter 1*e*, the infrared receiver 2 outputs a reception signal to the central controller 4. As described above, the infrared transmitter 1*e* transmits infrared rays as a beam limited to the tube axis direction of the fire-extinguishing nozzle 1*d*. Therefore, in a state where the infrared receiver 2 faces the infrared transmitter 1*e*, that is, in a state where the infrared receiver 2 is positioned in the tube axis direction of the fire-extinguishing nozzle 1*d*, the infrared receiver 2 receives the infrared rays from the infrared transmitter 1*e*.

That is, in a state where the position of the infrared receiver 2 is shifted from the tube axis direction of the fire-extinguishing nozzle 1*d*, the infrared receiver 2 does not receive the infrared rays from the infrared transmitter 1*e*. In other words, only in a state where the tube axis direction of the fire-extinguishing nozzle 1*d* in the fire-extinguishing apparatus 1 is set to a direction of the infrared receiver 2 positioned at the top portion of one of the plant units U1 to U6, the infrared receiver 2 receives the infrared rays from the infrared transmitter 1*e*.

The fire detector 3 is provided in each of the plant units U1 to U6, and when the fire detector 3 detects the occurrence of a fire in the plant units U1 to U6, the fire detector 3 outputs a fire detection signal to the central controller 4. The fire detector 3 detects the occurrence of a fire, for example, by detecting the absence or presence of flames from a fire.

The fire detection signal includes the unit number of the plant units U1 to U6 in addition to information indicating the detection of a fire.

The central controller 4 collectively monitors and controls the operating states of the facility such as the plant in which the plurality of plant units U1 to U6 are installed. As part of the function of monitoring the operating states of the facility, the central controller 4 performs a fire-fighting operation by controlling the fire-extinguishing apparatus 1 when a fire occurs in any of the plant units U1 to U6.

That is, when the fire detection signal is input from the fire detector 3, the central controller 4 controls the fire-extinguishing apparatus 1 on the basis of the reception signal input from the infrared receiver 2 and a control table stored in advance by executing a predetermined fire extinguishing program to extinguish the fire in the plant units U1 to U6. On the control table, data (initial direction data) indicating an initial setting direction (initial direction) of the direction of the fire-extinguishing nozzle 1*d* corresponding to each of the plant units U1 to U6 is registered.

Figure 3:
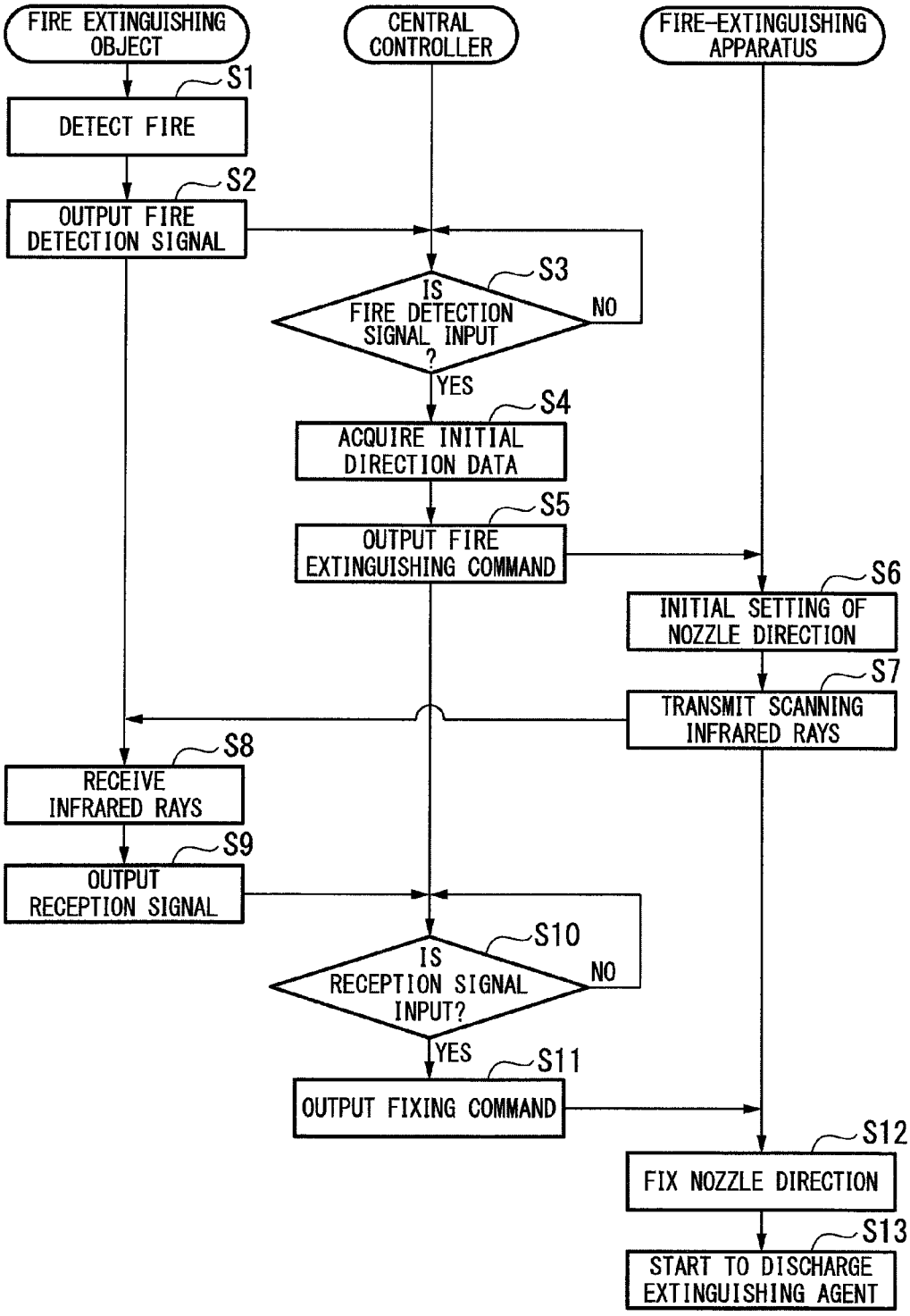
FIG. 3 is a flowchart showing an operation of the fire-extinguishing equipment according to the embodiment of the present disclosure.

Next, an operation of the fire-extinguishing equipment configured as described above will be described in detail according to the flowchart of FIG. 3.

In the plurality of plant units U1 to U6, when a fire occurs, the fire detector 3 detects the occurrence of the fire (Step S1), and outputs a fire detection signal to the central controller 4 (Step S2). When the central controller 4 receives the fire detection signal (Step S3), by searching the control table using the unit number included in the fire detection signal, the central controller 4 acquires initial direction data regarding the plant unit where the fire has occurred (for example, the plant unit U1) (Step S4). The central controller 4 outputs a fire extinguishing command including the acquired initial direction data to the fire-extinguishing apparatus 1 (Step S5).

The fire-extinguishing apparatus 1 performs a fire-extinguishing operation on the plant unit where the fire has occurred (for example, the plant unit U1) on the basis of the fire extinguishing command input from the central controller 4. In the fire-extinguishing operation, the joint 1*c* is initially operated such that the direction of the fire-extinguishing nozzle 1*d* is set to the direction indicated by the initial direction data.

For example, in a case where the plant unit where the fire has occurred is the plant unit U1, the direction of the fire-extinguishing nozzle 1*d* on the horizontal plane and the vertical plane is initially set to the direction of the plant unit U1 (Step S6). That is, in this state, the transmission direction of infrared rays from the infrared transmitter 1*e* is set to the initial setting direction of the plant unit U1.

When the direction of the fire-extinguishing nozzle 1*d* is set to the initial setting direction as described above, the fire-extinguishing apparatus 1 transmits infrared rays in a state where the direction of the fire-extinguishing nozzle 1*d* is set to the initial setting direction, and further transmits the infrared rays while sequentially moving (scanning) the transmission direction of the infrared rays in a predetermined range with respect to the initial setting direction (Step S7). When the infrared receiver 2 of the plant unit where the fire has occurred (for example, the plant unit U1) receives the infrared rays of which the transmission direction is sequentially moved as described above (Step S8), the infrared receiver 2 outputs a reception signal of the infrared rays to the central controller 4 (Step S9).

When the central controller 4 receives the reception signal from the infrared receiver 2 (Step S10), the central controller 4 outputs a fixing command for instructing the direction of the fire-extinguishing nozzle 1*d* to be fixed, to the fire-extinguishing apparatus 1 (Step S11). As a result, the operation of the joint 1*c* in the fire-extinguishing apparatus 1 is stopped, and the direction of the fire-extinguishing nozzle 1*d* is fixed in a state where the infrared receiver 2 of the plant unit where the fire has occurred (for example, the plant unit U1) receives the infrared rays transmitted from the infrared transmitter 1*e* of the fire-extinguishing apparatus 1. That is, the direction of the fire-extinguishing nozzle 1*d* is fixed in a state where the infrared transmitter 1*e* of the fire-extinguishing apparatus 1 faces the infrared receiver 2 of the plant unit where the fire has occurred (for example, the plant unit U1) (Step S12). The fire-extinguishing apparatus 1 starts to discharge the powder extinguishing agent in a state where the direction of the fire-extinguishing nozzle 1*d* is directed to the plant unit where the fire has occurred (for example, the plant unit U1) as described above (Step S13).

Here, the initial setting direction of the fire-extinguishing nozzle 1*d* indicated by the initial direction data is a direction in which the infrared transmitter 1*e* of the fire-extinguishing apparatus 1 faces the infrared receiver 2 of the plant unit where the fire has occurred.

However, due to setting errors of the direction of the fire-extinguishing nozzle 1*d* caused by the joint 1*c* and the like, a state may occur in which the infrared transmitter 1*e* of the fire-extinguishing apparatus 1 does not face the infrared receiver 2 of the plant unit where the fire has occurred even when the direction of the fire-extinguishing nozzle 1*d* is set to the initial setting direction, that is, there may be a case where the powder extinguishing agent discharged from the fire-extinguishing nozzle 1*d* in the initial setting direction does not hit the plant unit where the fire has occurred.

In consideration of this case, in the fire-extinguishing equipment of this embodiment, the infrared rays are transmitted while changing the direction of the fire-extinguishing nozzle 1*d*, and the direction of the fire-extinguishing nozzle 1*d* is fixed in a state where the infrared rays are received by the infrared receiver 2 of the plant unit where the fire has occurred. Therefore, the powder extinguishing agent discharged from the fire-extinguishing nozzle 1*d* can be allowed to reliably hit the plant unit where the fire has occurred.

In addition, according to the fire-extinguishing equipment of this embodiment, the discharge of the powder extinguishing agent is started when the infrared rays transmitted from the infrared transmitter 1*e* of the fire-extinguishing apparatus 1 are received by the infrared receiver 2 of the plant unit where the fire has occurred. Therefore, it is possible to perform the fire-fighting operation more accurately and rapidly than in the related art in which an infrared camera is used.

The shapes and combinations of the constituent members described in the embodiment described above are only examples, and additions, omissions, and substitutions of the configurations and other changes can be made without departing from the spirit of the present disclosure. The present disclosure is not limited to the above description and is limited only by the appended claims. In the present disclosure, for example, the following modification examples can be considered.

(1) In the embodiment described above, the infrared rays are transmitted in a state where the direction of the fire-extinguishing nozzle 1*d* is set to the initial setting direction and the infrared rays are transmitted while the transmission direction of the infrared rays is sequentially moved in a predetermined direction range. However, the present disclosure is not limited thereto. In a case where the factor in an error between the initial setting direction and the actual directions of the plant units U1 to U6 can be negligible, the infrared receiver 2 of the plant unit where the fire has occurred reliably receives the infrared rays transmitted from the infrared transmitter 1*e* in a state where the direction of the fire-extinguishing nozzle 1*d* is set to the initial setting direction. Therefore, the step of transmitting the infrared rays while the transmission direction of the infrared rays is sequentially moved can be spared.

In this case, when the infrared rays transmitted from the infrared transmitter 1*e* are received by the infrared receiver 2 of the plant unit where the fire has occurred in a state where the direction of the fire-extinguishing nozzle 1*d* is set to the initial setting direction, the powder extinguishing agent is discharged from the fire-extinguishing nozzle 1*d* toward the plant unit where the fire has occurred, thereby extinguishing the fire.

(2) In the embodiment described above, the infrared transmitter 1*e* is provided in the fire-extinguishing apparatus 1 and the infrared receiver 2 is provided in each of the plant units U1 to U6. However, the present disclosure is not limited thereto. The infrared receiver may be provided in the fire-extinguishing apparatus 1, and the infrared transmitter may be provided in each of the plant units U1 to U6. That is, the relationship between the transmission and reception of the infrared rays may be switched.

In this case, when the fire detector 3 detects a fire, the infrared transmitter provided together with the fire detector 3 starts to transmit infrared rays. When the infrared transmitter provided in the fire-extinguishing apparatus 1 detects the infrared rays transmitted from the infrared transmitter, the discharge of the powder extinguishing agent toward the plant unit where the fire has occurred from the fire-extinguishing nozzle 1*d* is started. As necessary, the infrared rays are transmitted while the transmission direction of the infrared rays is sequentially moved in a predetermined direction range, thereby avoiding the discharge of the powder extinguishing agent in an inappropriate direction due to the above-described error factor.

(3) In the embodiment described above, the fire extinguishing performed by the equipment provided with the plurality of (six) plant units U1 to U6 is described. However, the present disclosure is not limited thereto. The number of plant units may be one or another number.

In addition, in the embodiment described above, the case where the powder extinguishing agent is used as the extinguishing agent is described. However, the present disclosure is not limited thereto. Instead of the powder extinguishing agent, for example, a liquid extinguishing agent may also be used.

(4) In the embodiment described above, the case where the infrared rays were used as the electromagnetic waves is described. However, the present disclosure is not limited thereto. Electromagnetic waves other than the infrared rays, for example, laser light or microwaves may also be used.

INDUSTRIAL APPLICABILITY

According to the present disclosure, fire-extinguishing equipment capable of performing a fire-fighting operation more accurately and rapidly than in the related art can be provided.

The invention claimed is:

1. A fire-extinguishing equipment comprising:

a fire-extinguishing apparatus which transmits electromagnetic waves in a predetermined output direction and discharges an extinguishing agent in a discharge direction identical to the output direction;

an electromagnetic wave-receiver which is provided in a fire extinguishing object and receives the electromagnetic waves; and a controller which controls the fire-extinguishing apparatus to start to discharge the extinguishing agent when the output direction is set to a direction of the fire extinguishing object and the electromagnetic wave-receiver receives the electromagnetic waves, wherein the fire-extinguishing apparatus has (i) an electromagnetic wave-transmitter which transmits the electromagnetic waves and (ii) a nozzle from which the extinguishing agent is discharged, the electromagnetic wave-transmitter being fixed to the nozzle such that the output direction of the electromagnetic waves is identical to the discharge direction of the extinguishing agent from the nozzle, and wherein the electromagnetic wave-receiver outputs a reception signal to the controller when the electromagnetic wave-receiver receives the electromagnetic waves from the electromagnetic wave-transmitter, and the controller outputs, to the fire-extinguishing apparatus, a fixing command for instructing the direction of the nozzle to be fixed when the controller receives the reception signal from electromagnetic wave-receiver.

2. The fire-extinguishing equipment according to claim 1, wherein the output direction of the fire-extinguishing apparatus is adjustable, and wherein the fire-extinguishing apparatus transmits the electromagnetic waves while the output direction of the fire-extinguishing apparatus is sequentially changed from an initial direction, and when the electromagnetic wave-receiver receives the electromagnetic waves, the controller starts to discharge the extinguishing agent in a state where the output direction is fixed to a direction in which the electromagnetic waves are received.

3. The fire-extinguishing equipment according to claim 1, further comprising:

a fire detector provided in the fire extinguishing object, wherein, when the fire detector detects an occurrence of a fire and the electromagnetic wave-receiver receives the electromagnetic waves, the controller further controls the fire-extinguishing apparatus to start to discharge the extinguishing agent.

4. The fire-extinguishing equipment according to claim 3, further comprising a plurality of the fire extinguishing objects, wherein the electromagnetic wave-receiver and the fire detector are provided in each of the fire extinguishing objects, and wherein the controller stores in advance an initial output direction of the fire-extinguishing apparatus for each of the plurality of fire extinguishing objects, and sets the output direction of the fire-extinguishing apparatus to the initial output direction corresponding to the fire extinguishing object having the fire detector that detects the occurrence of the fire.

5. A fire-extinguishing equipment comprising:

a fire-extinguishing apparatus which is provided with an electromagnetic wave-receiver configured to receive electromagnetic waves, the fire-extinguishing apparatus configured to discharge an extinguishing agent in a discharge direction directly opposite to a receive direction of the electromagnetic waves; and an electromagnetic wave-transmitter provided in a fire extinguishing object and configured to transmit electromagnetic waves in a predetermined output direction; and a controller which controls the fire-extinguishing apparatus to start to discharge the extinguishing agent when the output direction is set to a direction of the fire-extinguishing apparatus and the electromagnetic wave-receiver receives the electromagnetic waves, wherein the fire-extinguishing apparatus has a nozzle from which the extinguishing agent is discharged, the electromagnetic wave-receiver being fixed to the nozzle such that the output direction of the electromagnetic waves is directly opposite to the discharge direction of the extinguishing agent from the nozzle, and wherein the electromagnetic wave-receiver outputs a reception signal to the controller when the electromagnetic wave-receiver receives the electromagnetic waves from the electromagnetic wave-transmitter, and the controller outputs, to the fire-extinguishing apparatus, a fixing command for instructing the direction of the nozzle to be fixed when the controller receives the reception signal from electromagnetic wave-receiver.

6. The fire-extinguishing equipment according to claim 1, wherein in response to a determination that a fire is detected on the fire extinguishing object, the controller is configured to transmit a fire-extinguishing command to the fire-extinguishing apparatus including an initial direction corresponding to a position of the fire extinguishing object, and wherein in response to receiving the fire-extinguishing command, the fire-extinguishing apparatus sequentially changes the output direction towards the initial direction corresponding to the position of the fire extinguishing object while the electromagnetic waves are transmitted, and wherein in response to a determination that the electromagnetic wave-receiver receives the electromagnetic waves, the controller is configured to transmit the set position command such that the output direction is fixed to a direction in which the electromagnetic waves are received.

* * * * *